US009199455B2

(12) United States Patent
Vandenberghe et al.

(10) Patent No.: US 9,199,455 B2
(45) Date of Patent: Dec. 1, 2015

(54) PRINTHEAD

(75) Inventors: Kenneth L. Vandenberghe, Junction City, OR (US); David Pidwerbecki, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/978,564

(22) PCT Filed: Jan. 31, 2011

(86) PCT No.: PCT/US2011/023249

§ 371 (c)(1), (2), (4) Date: Jul. 8, 2013

(87) PCT Pub. No.: WO2012/105953

PCT Pub. Date: Aug. 9, 2012

(65) Prior Publication Data

US 2013/0293628 A1 Nov. 7, 2013

(51) Int. Cl.

| | |
|---|---|
| ***B41J 2/165*** | (2006.01) |
| ***B41J 2/14*** | (2006.01) |
| ***B41J 2/16*** | (2006.01) |

(52) U.S. Cl.

CPC .. *B41J 2/14* (2013.01); *B41J 2/161* (2013.01); *B41J 2/1623* (2013.01); *B41J 2/1626* (2013.01); *B41J 2/1628* (2013.01); *B41J 2/1629* (2013.01); *B41J 2/1631* (2013.01); *B41J 2/1642* (2013.01); *B41J 2/1645* (2013.01); *B41J 2/1646* (2013.01)

(58) Field of Classification Search

None

See application file for complete search history.

(56) References Cited

U.S. PATENT DOCUMENTS

| | | | | |
|---|---|---|---|---|
| 4,215,354 | A * | 7/1980 | Larsson | 347/94 |
| 4,353,078 | A * | 10/1982 | Lee et al. | 347/70 |
| 5,872,582 | A | 2/1999 | Pan | |
| 6,491,375 | B1 | 12/2002 | Fitch | |
| 6,955,418 | B2 | 10/2005 | Ito | |
| 7,182,432 | B2 | 2/2007 | Van Den Berg et al. | |
| 7,278,710 | B2 | 10/2007 | Hirota et al. | |
| 7,438,403 | B2 | 10/2008 | Takahashi | |
| 2001/0050704 | A1 | 12/2001 | Tachihara et al. | |
| 2008/0204520 | A1 | 8/2008 | Karlinski et al. | |
| 2010/0039479 | A1 | 2/2010 | Bibl et al. | |

* cited by examiner

*Primary Examiner* — Alejandro Valencia

(74) *Attorney, Agent, or Firm* — Dierker & Associates, P.C.

(57) ABSTRACT

A printhead is disclosed herein. The printhead includes a die substrate having a surface. A trench is defined in the die substrate surface, and a support is positioned in the trench. A compliant membrane is attached to the die substrate surface, and a gap is defined between a distal end of the support and the compliant membrane.

10 Claims, 8 Drawing Sheets

PRINTHEAD

BACKGROUND

The present disclosure relates generally to printheads.

Inkjet printing creates images by propelling ink droplets onto a medium. An inkjet print head includes an array or a matrix of ink nozzles, with each nozzle selectively ejecting ink droplets. The number of operating nozzles and the drop volume establish the ink flow from an ink reservoir or supply, which may be an intermediary ink tank placed in close proximity to the print head or a remote ink tank. When printing average density images, the print head tends to consume steady amounts of ink. However, sudden changes in ink consumption often occur at the beginning and the end of the printing process. The energy used during an ink firing event may create motion of the ink in the firing chamber and ink delivery system, which may cause fluidic interaction between neighboring ink channels. When the interactions are large enough, crosstalk may occur, where the firing event of one channel may cause a disturbance in neighboring channel firing events.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the printhead disclosed herein include a die substrate that has a compliant membrane attached to a surface thereof. A trench is also defined in the die substrate surface, and supports are formed in the trench. At least some of the supports in the trench do not support the compliant membrane (i.e., a gap is formed between the support(s) and the compliant membrane), which allows the complaint membrane to flex in and out of plane as the pressure in the ink changes during a firing event. It is believed that some of the fluidic interaction between channels is dissipated by flexing the compliant membrane. This can reduce crosstalk between neighboring ink channels. The addition of the gap between some of the supports and the compliant membrane, as opposed to eliminating the supports altogether, aids in preventing the compliant membrane from breaking, for example, during manufacturing, while still allowing the compliant membrane to flex.

Figure 1A:
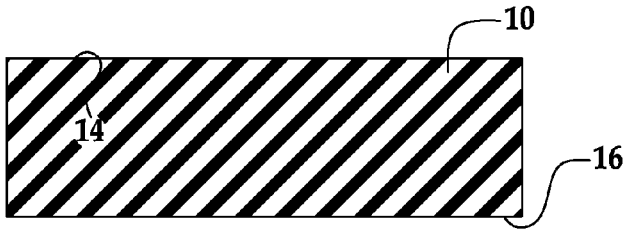
FIGS. 1A through 1G illustrate cross-sectional views of a die substrate throughout an example of a method for forming a die substrate having a compliant membrane attached thereto.

Referring now to FIGS. 1A through 1G, an example of a method for making an example of the die substrate 10 having the compliant membrane 12 attached thereto is schematically depicted. In FIG. 1A, the die substrate 10 is shown prior to any processing. The die substrate 10 may be any suitable material, including silicon, carbon, stainless steel, KOVAR® (CRS Holdings, Inc.), glass, or other suitable materials. The dimensions of the die substrate 10 may vary depending, at least in part, on the size of the printhead that the die substrate 10 will be incorporated into. In one example, the die substrate 10 has a diameter ranging from about 50 mm to about 400 mm and a thickness ranging from about 400 μm to about 5000 μm. In another example, the thickness ranges from about 500 μm to about 1200 μm.

Figure 1B:
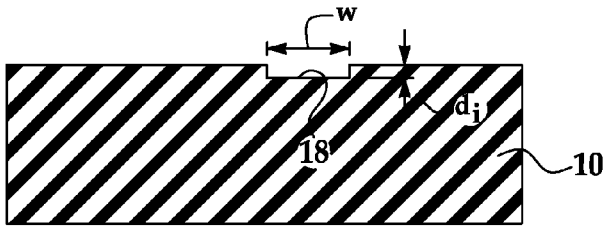

The die substrate 10 has two opposed side surfaces 14, 16. As illustrated in FIG. 1B, a depression 18 is formed in the side surface 14. However, it is to be understood that the depression 18 could be formed in the side surface 16. The depression 18 extends along the surface 14 (in a direction going into the paper) of the die substrate 10. The other dimensions of the depression 18 include a depth (initial depth $d_i$ and final depth $d_f$) and a width w. In one example, the initial depth $d_i$ ranges from about 0.5 μm to about 10 μm and the width w ranges from about 100 μm to about 2000 μm. In another example, the initial depth $d_i$ is about 5 μm and the width w is about 350 μm.

In one example, the depression 18 may be formed via chemical etching or via machining/punching techniques. In another example, the depression 18 may be formed using photolithography and etching. Photolithography uses light to transfer the desired geometric pattern for the depression 18 from a photo mask to a photoresist (not shown) on the die substrate 10. The etching process is then used to engrave the pattern into the die substrate 10. Suitable etching techniques include, for example, reactive ion etching or plasma etching. The photoresist is removed and the die substrate 10 remains with the depression 18 formed therein.

Figure 1C:
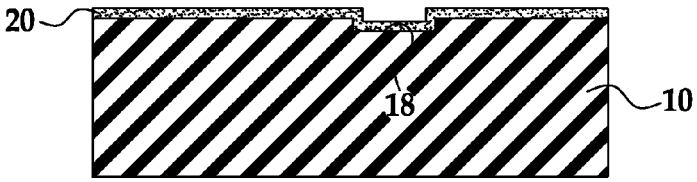

After the depression 18 is formed in the surface 14, a hardmask 20 is deposited on the die substrate surface 14, including in the depression 18 (as shown in FIG. 1C). A conformal deposition technique may be used so that the resulting hardmask 20 also has a slight depression therein. Examples of suitable deposition techniques include sputter deposition and chemical vapor deposition (CVD). The thickness of the hardmask 20 is less than the depth of the depression 18. In one example, the thickness of the hardmask 20 ranges from about 0.5 μm to about 5 μm. In another example, the thickness of the hardmask 20 is about 4 μm. An example of a suitable hardmask 20 includes tetraethylorthosilicate (TEOS, a precursor to silicon dioxide), aluminum, thermal oxide, and the like.

The example of the method shown in FIGS. 1A through 1G results in one side 14 of the die substrate 10 being processed, and a compliant membrane 12, being attached to the side 14. It is to be understood however, that if it is desirable, both sides 14 and 16 can be processed, as shown in FIGS. 2A through 2K.

Figure 1D:
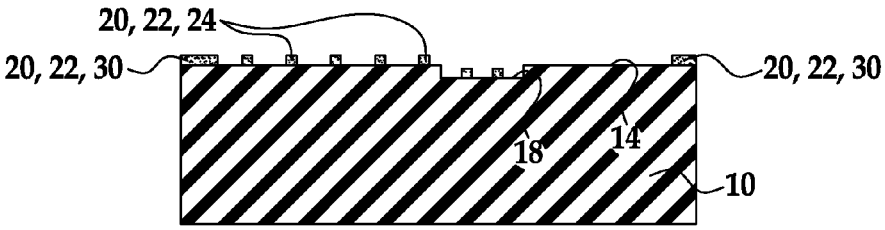

Referring now to FIG. 1D, the hardmask 20 is then patterned to form a mask 22 including portions 24 on the surface 14, some of which are located in the depression 18. This mask 22 may be formed by patterning the hardmask 20, using, for example, photolithography. In one example, the mask 22 is used to form a trench 26 and support(s) 28 (e.g., post(s), wall(s), or the like) in the trench 26 (see, e.g., FIG. 1E). It is to be understood that areas of the surface 14 not covered by the mask 22 are subsequently etched to form the trench 26 and support(s) 28. As such, the pattern of the mask 22 includes portion(s) 24 where it is desirable to form support(s) 28. The pattern of the mask 22 also includes end portions 30, which are not used to form support(s) 28, but rather are used to protect the underlying surface 14 from etching. The end portions 30 of the mask 22 preserve the end portions of the surface 14 (i.e., they remain unetched) for subsequent attachment to the compliant membrane 12 (see, e.g., FIG. 1G) and nozzle formation (see reference numeral 50 in FIG. 1G). In the example shown in FIG. 1D, the mask 22 includes two end portions 30 and seven portions 24 for forming the support(s) 28.

Figure 1E:
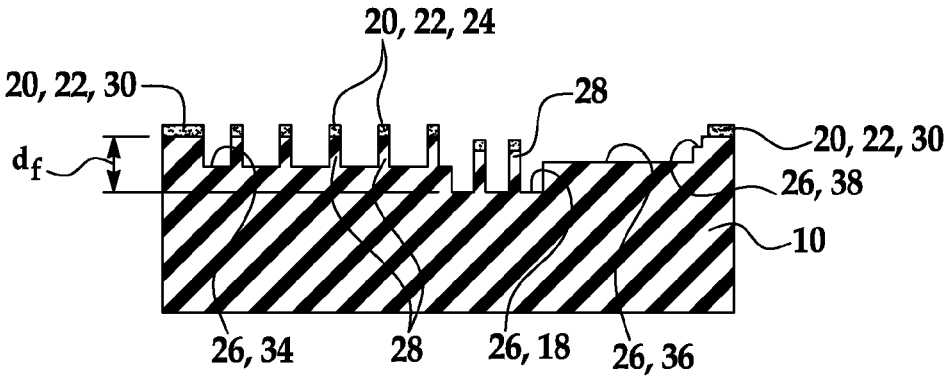

With the mask 22 in place, the surface 14 of the die substrate 10 is etched. The die substrate 10 after etching is complete is shown in FIG. 1E. Etching may be accomplished using reactive ion etching, dry plasma etching, Bosch etching, or the like.

The components formed as a result of etching will now be described in conjunction with FIG. 1E. As previously mentioned, the etching process forms the trench 26 defined in the surface 14 of the die substrate 10. The trench 26 includes the depression 18, whose initial depth $d_i$ is increased to a final depth $d_f$ as a result of etching. The trench 26 also includes shoulders 34, 36 that are adjacent to the depression 18. As can be seen in FIG. 1E, the depths of each of the shoulders 34, 36 (measured from the surface 14) is less than the final depth $d_f$ of the depression 18. In one example, the depth of the shoulder 36 (measured from the surface 14) is less than the depth of the shoulder 34 having the support(s) 28 formed thereon.

After etching, support(s) 28 are also formed beneath the portion(s) 24 of the mask 22. The supports 28 in the example shown in FIG. 1E are formed in the depression 18 and on the shoulder 34. It is to be understood that multiple supports 28 (e.g., in the form of posts, pillars, etc.) may form respective lines, both in the depression 18 and on the shoulder 34, which extend along the surface 14 of the die substrate 10 in a direction going into the paper. Each support 28 has two ends. The first of the two ends is attached to the depression 18 or the shoulder 34, and the second of the two ends is distal to the first end. As illustrated in FIG. 1E, the distal ends have the mask portions 24 attached thereto.

In some instances, etching may be used to form additional shoulders in the trench 26 as well. For example, another shoulder 38 is formed adjacent shoulder 36.

Figure 1F:
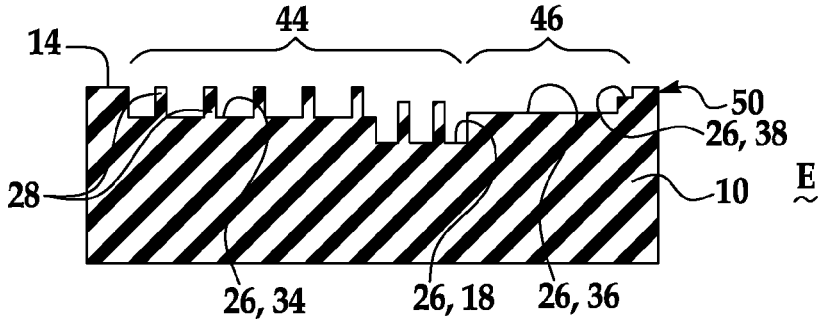

Referring now to FIG. 1F and as will be described further hereinbelow, the trench 26, together with the compliant membrane 12, defines a plenum 44 and a firing chamber 46. While not illustrated in these figures, it is to be understood that when the die substrate 10 is incorporated into a printhead (e.g., printhead 100 shown in FIG. 4), ink flows from a common ink supply to the plenum 44 and into the firing chamber 46, where it is dispensed through a nozzle 50. It is to be further understood that when a die substrate 10 is processed to include multiple respective trenches 26, each of the trenches 26 may be fluidly and operatively connected to a single common ink supply.

Also as shown in FIG. 1F, after the surface 14 is processed to form the trench 26 and supports 28, the mask 22 is removed and a nozzle 50 is formed. Depending upon the materials used for the mask 22, wet chemical removal processes may be used or dry etching removal processes may be used to remove the mask 22. Wet chemical removal processes may utilize a solvent or solvent mixture of the mask 22 that will not deleteriously affect the underlying die substrate 10. Wet chemical removal processes may also utilize another solution (e.g., an alkaline solution) to remove the mask 22. One example of a dry etching process is the use of $O_2$ plasma to strip the mask 22 without deleteriously affecting the underlying die substrate 10.

After mask 22 removal, the method further includes singulating a portion of the die to form a nozzle 50. The nozzle 50 is formed to fluidly connect the area of the trench 26 making up the firing chamber 46 to the exterior E of the die substrate 10. In the example shown in FIG. 1F, the nozzle 50 is formed through the portion of die substrate 10 that previously had an end portion 30 of the mask 20, 22 thereon and is adjacent the shoulder 38.

After the mask 22 is removed, the surface 14 (including the trench 26 surfaces) and the distal ends of the supports 28 are exposed. This is also shown in FIG. 1F. The compliant membrane 12 is then bonded to the surface 14. Bonding may be accomplished via an adhesive, anodic bonding (e.g., glass/silicon anodic bonding), plasma bonding, or the like. In one example, the compliant membranes 12, 12' are formed of glass, silicon, stainless steel, KOVAR®, KAPTON® (a polyimide film available from DuPont). The thickness of the compliant membrane 12 ranges, in one example, from about 2 μm to about 100 μm.

Figure 1G:
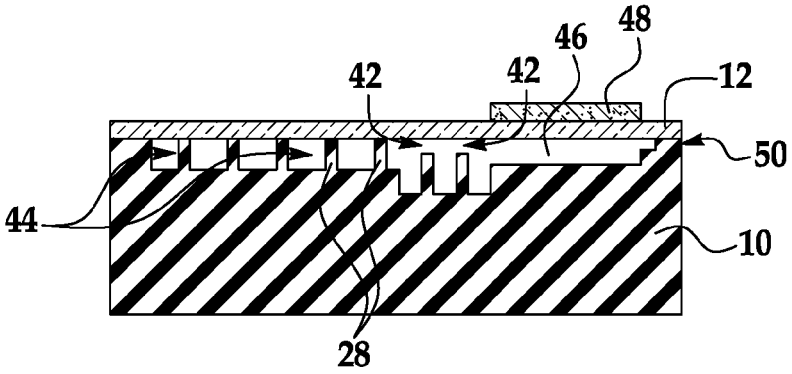

In the example shown in FIG. 1G, the distal ends of the supports 28 formed in the depression 18 are not planar with the portions of the surface 14 that were covered by the end portions 30 of the mask 22. On the contrary, the distal ends of the supports 28 formed on the shoulder 34 are substantially planar with the unetched portions of surface 14 that were covered by the end portions 30 of the mask 22. This is due, at least in part, to the fact that the final depth $d_f$ of the depression 18 is greater than the depth of the shoulder 34. In this example, when the compliant membrane 12 is attached to the surface 14, the supports 28 positioned on the shoulder 34 contact and support the compliant membrane 12 while the supports 28 positioned in the depression 18 do not contact and thus do not support the compliant membrane 12. As illustrated, there is a gap 42 formed between the supports 28 positioned in the depression 18 and the compliant membrane 12. It is to be understood that the supports 28 positioned on the shoulder 34 may be bonded to the compliant membrane 12.

When the compliant membrane 12 is in position, the previously mentioned plenum 44 and firing chamber 46 are formed. These components of the die substrate 10 (or 10') will be further described herein in reference to FIGS. 4 and 5.

The die substrate 10 disclosed herein may be used in piezoelectric inkjet printers, thermal inkjet printers, electrostatic inkjet printers, or continuous inkjet printers. FIG. 1G illustrates the die substrate 10 having a drop generating mechanism 48 positioned on, and attached to, the compliant membrane 12 adjacent to the firing chamber 46. When multiple trenches 26 are formed in a die substrate 10, it is to be understood that each firing chamber 46 is associated with a respective drop generating mechanism 48. An example of the drop generating mechanism 48 for piezoelectric inkjet die substrates includes a piezoelectric actuator (e.g., a piezo ceramic actuator). An example of the drop generating mechanism 48 for thermal inkjet die substrates includes a heating element (e.g., resistors). The drop generating mechanism 48 may be adhered to the compliant membrane 12 via an adhesive, using a sol gel technique, or using a deposition technique.

Figure 2A:
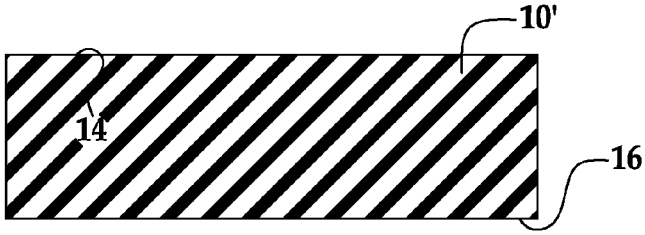
FIGS. 2A through 2K illustrate cross-sectional views of another example of a die substrate throughout another example of the method for forming a die substrate having multiple compliant membranes attached thereto.

Referring now to FIGS. 2A through 2K, an example of a method for making another example of the die substrate 10' having compliant membranes 12, 12' respective attached to both surfaces 14 and 16 is schematically depicted. In FIG. 2A, the die substrate 10' is shown prior to any processing. The previously described die substrate 10 is suitable for use as the die substrate 10'.

Figure 2B:
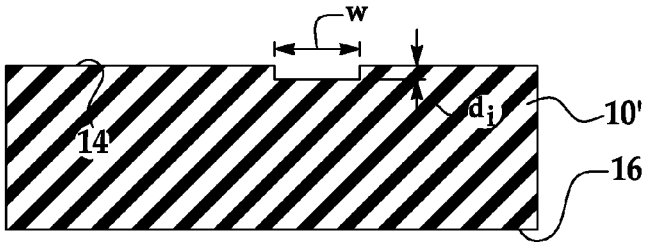
Figure 2C:
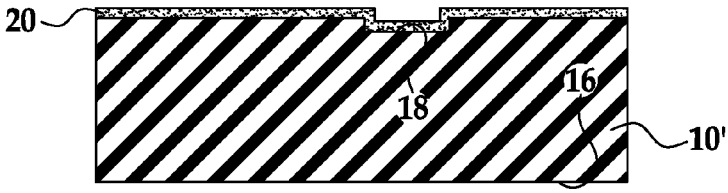

The die substrate 10' has two opposed side surfaces 14, 16. As illustrated in FIG. 2B, the depression 18 is formed in the side surface 14 in a manner similar to that described hereinabove. After the depression 18 is formed in the surface 14, a hardmask 20 is deposited on the die substrate surface 14, including in the depression 18, as shown in FIG. 2C. The techniques described hereinabove in reference to FIG. 1C may be used to deposit the hardmask 20 in this example, and the dimensions and materials previously described for the hardmask 20 may also be used in this example.

Figure 2D:
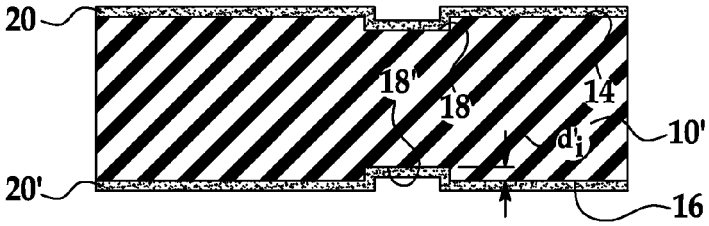

Referring now to FIG. 2D the steps described in conjunction with FIGS. 2B and 2C are repeated on the opposed surface 16 of the die substrate 10'. As such, a second depression 18' is formed in the surface 16 and a second hardmask 20' is deposited on the surface 16, including in the depression 18'. The processes and materials previously described may be used to form the second depression 18' and the second hardmask 20'.

Figure 2E:
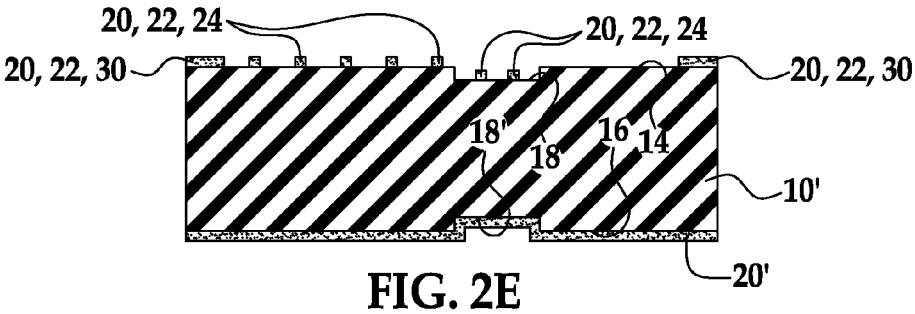

The first or second hardmask 20, 20' on one of the opposed surfaces 14, 16 is then patterned to form a mask 22, 22' including portions 24 on the surface 14, 16, some of which are located in the depression 18, 18'. FIG. 2E illustrates the mask 22 being formed on the surface 14. This mask 22 may be formed by patterning the hardmask 20, using, for example, photolithography. In one example, the mask 22 is used to form a trench 26 and support(s) 28 (e.g., post(s), wall(s), or the like) in the trench 26 (see, e.g., FIG. 2E). It is to be understood that areas of the surface 14 not covered by the mask 22 are subsequently etched to form the trench 26 and support(s) 28. As such, the pattern of the mask 22 includes portion(s) 24 where it is desirable to form support(s) 28. The pattern of the mask 22 also includes end portions 30, which are not used to form support(s) 28, but rather are used to protect the underlying surface 14 from etching. The end portions 30 of the mask 22 preserve the end portions of the surface 14 (i.e., they remain unetched) for subsequent attachment to the compliant membrane 12 (see, e.g., FIG. 2K) and nozzle 50 formation (see, e.g., FIG. 2K). In the example shown in FIG. 2E, the mask 22 includes two end portions 30 and seven portions 24 for forming the support(s) 28.

Figure 2F:
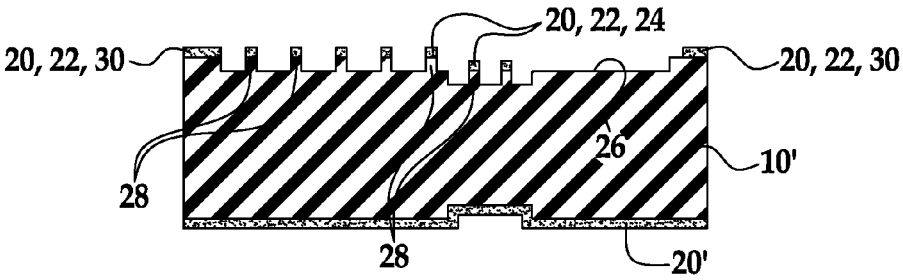
Figure 2G:
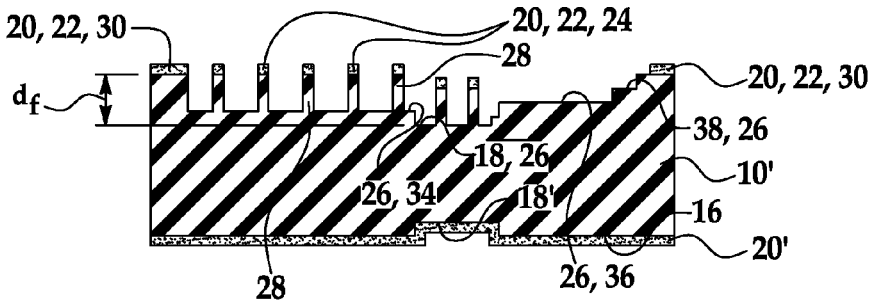
Figure 2H:
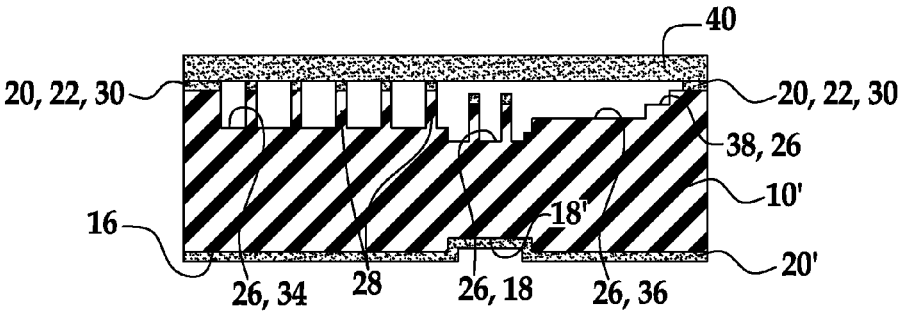

With the mask 22 in place, the surface 14 of the die substrate 10 is etched. The die substrate 10 after etching has been initiated is shown in FIG. 2F, and the die substrate 10 after etching is complete is shown in FIG. 2G. Etching may be accomplished using reactive ion etching, dry plasma etching, Bosch etching, or the like.

The components formed as a result of etching will now be described in conjunction with FIG. 2G. The complete etching process forms the trench 26 defined in the surface 14 of the die substrate 10'. The trench 26 includes the depression 18, whose initial depth $d_i$ is increased to a final depth $d_f$ as a result of etching. The trench 26 also includes shoulders 34, 36 that are adjacent to the depression 18. As can be seen in FIG. 2G, the depths of each of the shoulders 34, 36 (measured from the surface 14) is less than the final depth $d_f$ of the depression 18. In one example, the depth of the shoulder 36 (measured from the surface 14) is less than the depth of the shoulder 34 having the support(s) 28 formed thereon.

After etching, support(s) 28 are also formed beneath the portion(s) 24 of the mask 22. The supports 28 in the example shown in FIG. 2G are formed in the depression 18 and on the shoulder 34. It is to be understood that multiple supports 28 (e.g., in the form of pillars, posts, etc.) may form respective lines, both in the depression 18 and on the shoulder 34, which extend along the surface 14 of the die substrate 10' in a direction going into the paper. Each support 28 has two ends. The first of the two ends is attached to the depression 18 or the shoulder 34, and the second of the two ends is distal to the first end. As illustrated in FIG. 2G, the distal ends have the mask portions 24 attached thereto.

In some instances, etching may be used to form additional shoulders in the trench 26 as well. For example, between the shoulder 36 and the surface 14 is another shoulder 38.

As previously mentioned, the method shown in FIGS. 2A through 2K results in both sides 14, 16 of the die substrate 10 being processed. As such, in this example of the method, after the etching process is complete on the one side of the die substrate 10', a protective layer 40 is positioned over the trench 26 and in contact with at least the end portions 30 of the mask 20, 22. In one example, the protective layer 40 may be a photoresist that will protect the covered components (e.g., trench 26, supports 28, etc.) while the other die surface 16 is being processed. One example of a photoresist that is suitable for use as the protective layer 40 is SUB. It is to be understood that any other dry film resist or other suitable protective material may be used. The protective layer 40 may be established via spin coating and curing.

Figure 2I:
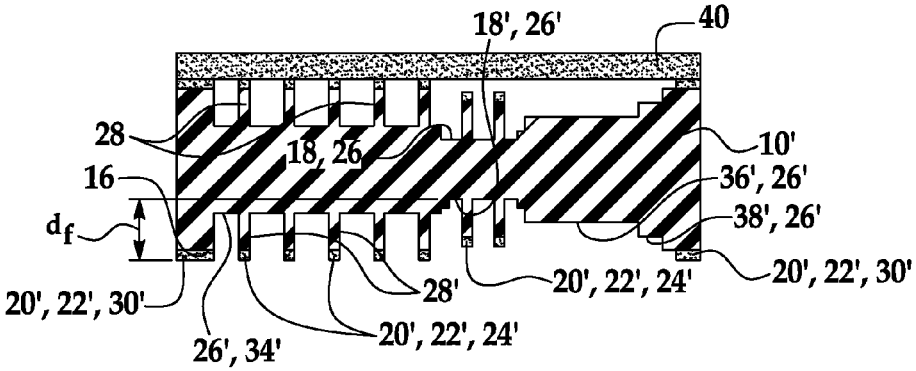

While not shown in the Figures, it is to be understood that once the protective layer 40 is in place, the die substrate 10 may be rotated, flipped, moved, etc. to any suitable position in order to process the other surface 16. As shown in FIG. 2I, the second hardmask 20' is patterned to form a mask 22' including portions 24' on both the surface 16 and the depression 18'. In one example, the mask 22' is a mirror image of the mask 22. Also as shown in FIG. 2I, the exposed portions of die substrate surface 16 (i.e., the surface 16 portions not covered by the mask 22') are etched to form a second trench 26' and support(s) 28'.

The trench 26' includes depression 18', the final depth $d'_f$ of which is increased from the initial depth $d'_i$ as a result of the etching process. The trench 26' also includes shoulders 34', 36' that are adjacent to the depression 18'. As can be seen in FIG. 2I, the depths of each of the shoulders 34', 36' (measured from the surface 16) is less than the final depth $d'_f$ of the depression 18'. In one example, the depth of the shoulder 36' (measured from the surface 16) is less than the depth of the shoulder 34' having the support(s) 28' formed thereon. The supports 28' in this example are formed in the depression 18' and on the shoulder 34'. It is to be understood that multiple supports 28' (e.g., in the form of pillars, posts, etc.) may form respective lines, both in the depression 18' and on the shoulder 34', which extend along the surface 16 of the die substrate 10' in a direction going into the paper. Each support 28' has two ends. The first of the two ends is attached to the depression 18' or the shoulder 34', and the second of the two ends is distal to the first end. As illustrated in FIG. 2I, the distal ends have the mask portions 24' attached thereto.

Figure 2J:
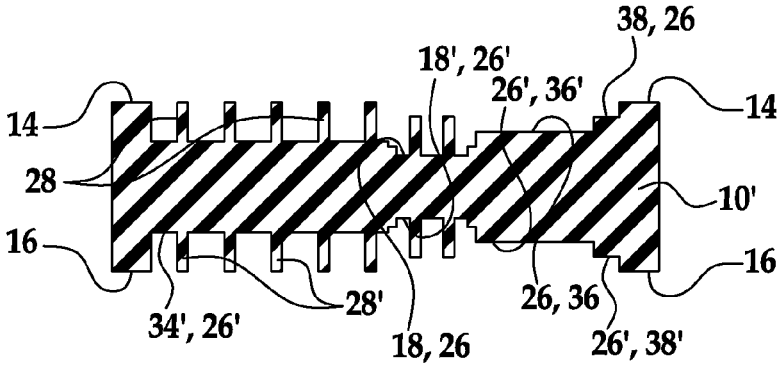

After both surfaces 14 and 16 have been processed to form the respective trenches 26, 26' and supports 28, 28', the protective layer 40 and masks 22, 22' are removed, as shown in FIG. 2J. Depending upon the materials used for the protective layer 40 and the masks 22, 22', wet chemical removal processes may be used or dry etching removal processes may be used. Wet chemical removal processes may utilize a solvent or solvent mixture of the protective layer 40 and masks 22, 22' that will not deleteriously affect the underlying die substrate 10. Wet chemical removal processes may also utilize another solution (e.g., an alkaline solution) to remove the protective layer 40 and masks 22, 22'. One example of a dry etching process is the use of $O_2$ plasma to strip the protective layer 40 and the masks 22, 22' without deleteriously affecting the underlying die substrate 10.

After the protective layer 40 and the masks 22, 22' are removed, the surfaces 14, 16 (including the trench 26, 26' surfaces) and the distal ends of the supports 28, 28' are exposed. This is shown in FIG. 2J.

This example of the method further includes singulating portions of the die substrate 10' to form nozzles 50, 50'. The nozzles 50, 50' are formed to fluidly connect, respectively, the area of the trench 26 making up the firing chamber 46, 46' to the exterior E of the die substrate 10'. In the example shown in FIG. 2K, the nozzles 50, 50' are formed through portions of die substrate 10' that previously had an end portion 30, 30' of the mask 20, 20' thereon and are respectively adjacent the shoulder 38, 38'.

The compliant membranes 12 and 12' are then bonded to the respective surfaces 14 and 16. In one example, the compliant membranes 12, 12' are formed of glass, silicon, stainless steel, KOVAR®, KAPTON® (a polyimide film available from DuPont). The thickness of the compliant membranes 12, 12' ranges, in one example, from about 2 μm to about 100 μm. Bonding may be accomplished as previously described in reference to FIG. 1G.

Figure 2K:
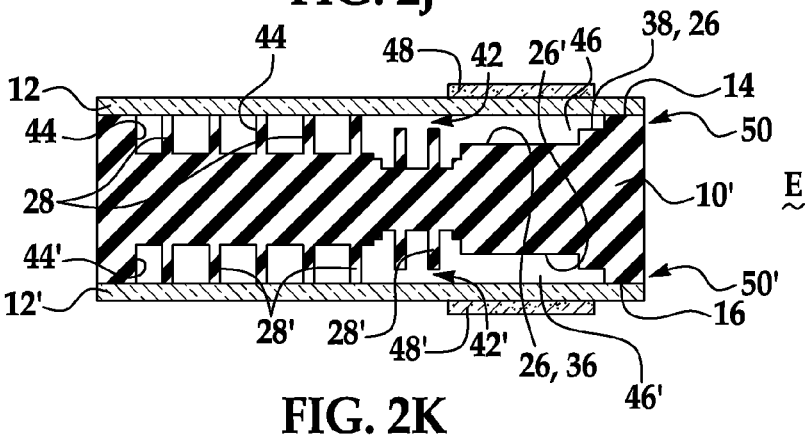

In the example shown in FIG. 2K, the distal ends of the supports 28 and 28' respectively formed in the depressions 18 and 18' are not planar with the respective surfaces 14 and 16 that were covered by the end portions 30 and 30' of the respective masks 22 and 22'. On the contrary, the distal ends of the supports 28 and 28' respectively formed on the shoulders 34 and 34' are substantially planar with the respective surfaces 14 and 16 that were covered by the end portions 30 and 30' of the respective masks 22 and 22'. This is due to the fact that final depths $d_f$ and $d'_f$ of the depressions 18 and 18' are greater than the depths of the respective shoulders 34 and 34'. In this example, when the compliant membrane 12 is attached to the surface 14, the supports 28 positioned on the shoulder 34 contact and support the compliant membrane 12 while the supports 28 positioned in the depression 18 do not support the compliant membrane 12. As illustrated, there is a gap 42 formed between the supports 28 positioned in the depression 18 and the compliant membrane 12. Also in this example, when the compliant membrane 12' is attached to the surface 16, the supports 28' positioned on the shoulder 34' contact and support the compliant membrane 12' while the supports 28' positioned in the depression 18' do not support the compliant membrane 12'. As illustrated, there is a gap 42' formed between the supports 28' positioned in the depression 18' and the compliant membrane 12'. It is to be understood that the supports 28 and 28' positioned on the respective shoulders 34 and 34' may be bonded to the respective compliant membranes 12 and 12'.

When the compliant membranes 12, 12' are in position, a plenum 44, 44' and a firing chamber 46, 46' are respectively formed between the compliant membranes 12, 12' and the trenches 26, 26'. These components 44, 44' and 46, 46' are shown in FIG. 2K. While not illustrated in this figure, it is to be understood that when the die substrate 10' is incorporated into a printhead, ink flows from a common ink supply to the respective plenums 44, 44' and into the respective firing chambers 46, 46', where it is dispensed through the respective nozzles 50, 50'. It is to be further understood that when a die substrate 10 is processed to include multiple respective trenches 26, each of the trenches 26 may be fluidly and operatively connected to a single common ink supply.

It is to be understood that the die substrate 10' shown in FIG. 2K having the compliant membranes 12, 12' attached thereto may also have attached thereto the previously described drop generating mechanism 48. In this example, however, respective drop generating mechanisms 48, 48' (see, e.g., FIG. 3) are attached to the compliant membranes 12, 12' adjacent to the respective firing chambers 46, 46'. Each of the drop generating mechanisms 48, 48' may be individually addressed (via circuitry not shown) to eject ink droplets from the respective nozzles 50, 50'.

Figure 3:
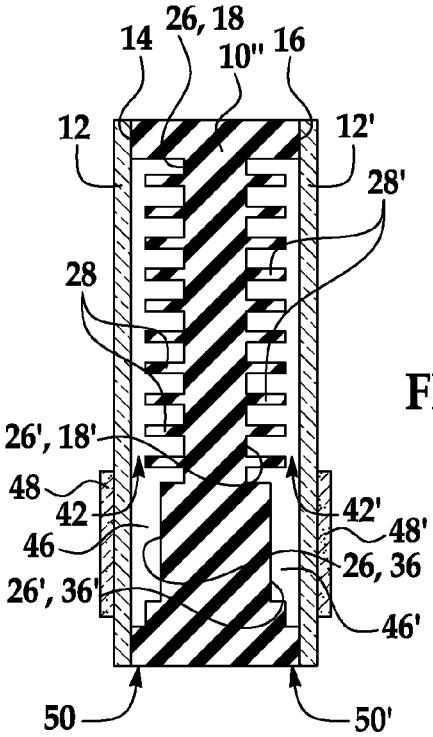
FIG. 3 is a cross-sectional view of another example of the die substrate having a compliant membrane attached thereto.

FIG. 3 illustrates another example of the die substrate 10" that can be formed via an example of the method disclosed herein. In this example, the originally formed depressions 18, 18' (not shown in FIG. 3) are wider than those described in reference to FIGS. 2B and 2C, and the masks 22, 22' (also not shown in FIG. 3) are patterned so that when etching is performed, supports 28 are formed in the depressions 18, 18' alone and a single shoulder 36, 36' is formed adjacent each of the depressions 18, 18'. In this example, the gaps 42, 42' are positioned between the distal ends of the supports 28 formed in the depressions 18, 18' and the respective compliant membranes 12, 12'. However, none of the supports 28, 28' contact, support or are bonded to the respective compliant membranes 12, 12'. It may be desirable, in this example, to utilize thicker compliant membranes 12, 12' than those previously described (e.g., thickness may be greater than 100 μm).

As previously mentioned, the gaps 42, 42' discussed in the examples disclosed herein are formed between the distal ends of the supports 28 formed in the depressions 18, 18' and the respective compliant membranes 12, 12'. In one example, the distance that makes up the gaps 42, 42' may range from about 0.5 μm and about 15 μm. This distance or gap 42, 42' allows the compliant membranes 12, 12' to flex when ink in the plenum 44, 44' and/or firing chamber 46, 46' experiences a change in pressure. Due, at least in part, to the position of the compliant membranes 12, 12' with respect to the drop generating members 48, 48' and the firing chamber 46, 46', the compliant membranes 12, 12' are able to absorb some of the energy from a firing/activation event that may otherwise cause undesirable crosstalk. In the examples disclosed herein, it is believed that crosstalk is reduced to 10% or less (e.g., to about 6%), which is believed to be an improvement over printheads having crosstalk ranging from 8% to 20% (e.g., those with no compliant membranes or those with different compliant membranes).

Figure 4:
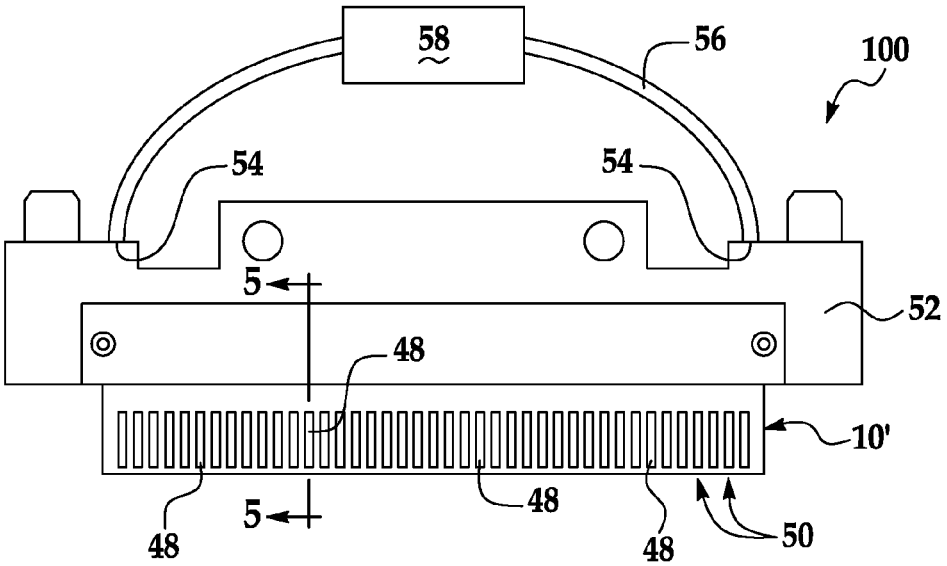
FIG. 4 is a schematic illustration of an example of a printhead.
Figure 5:
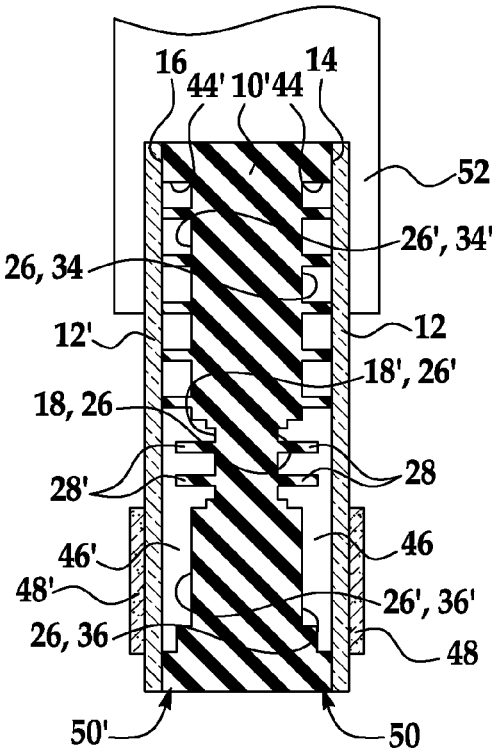
FIG. 5 is a cross-sectional view (taken along line 5-5 of FIG. 4) of part of a printhead showing an example of a die substrate with the addition of drop generating mechanisms on the compliant membrane and inserted into a holder of the printhead.

Referring now to FIGS. 4 and 5, an example of the printhead 100 incorporating an example of the die substrate 10', having compliant membranes 12, 12' and drop generating mechanisms 48, 48' attached thereto, is depicted. In FIG. 4, the die substrate 10' is shown from a top view, such as, for example, as if looking directly at surface 14, which has compliant membrane 12 and multiple drop generating mechanisms 48 attached thereto. A cross-sectional view of a portion of the printhead 100, including a portion of the die substrate 10', is shown in FIG. 5. This example of the die substrate 10' has a plurality of trenches 26, 26' formed therein and has a drop generating mechanism 48, 48' positioned adjacent to each firing chamber 46, 46' of each trench 26, 26'. The numerous drop generating mechanisms 48 are illustrated in FIG. 4.

As shown in both FIGS. 4 and 5, the die substrate 10' (having been processed such that compliant membranes 12, 12' and drop generating mechanisms 48, 48' are attached thereto) is supported by a holder 52. In one example, the die substrate 10' is attached to the holder 52 via an adhesive (e.g., epoxy or glue). The holder 52 may include a recess therein for distributing ink to the plenums 44, 44' and the firing chambers 46, 46'. As shown in FIG. 4, an ink supply port/inlet 54, with the help of tubing 56 connects the recess of the holder 52 and the plenums 44, 44' of the die substrate 10' with a main or an interim ink tank 58.

In a stand-by mode of operation, the plenums 44, 44', the firing chambers 46, 46', the recess, and the tubing 56 are filled with ink. When the printhead 100 becomes operative, the drop ejection or ink firing process depletes ink in print head 100. The process is known as "ink starvation." The tank 58 replenishes the ink, although the replenishment takes place after a certain delay. Initially, the pressure of ink in the vicinity of nozzles 50, 50' decreases, and a negative pressure front proceeds through the printhead 100 and tubing 56 towards ink tank 58. After the delay (which is defined by the distance from the nozzles 50, 50' to tank 58) divided by the speed of sound in the ink, the ink begins to flow towards the recess, the plenums 44, 44', and the firing chambers 46, 46'. Until replenished ink reaches the plenums 44, 44', the firing chambers 46, 46', and the nozzles 50, 50', the delay is further increased by the value of the time it takes the ink to travel the distance.

At the beginning of printhead 100 operation, the pressure may fall. It is believed that the die substrate 10', including supports 28, 28' formed in the depressions 18, 18' such that the supports 28 do not support the compliant membranes 12, 12' allow for the reduction of or even elimination of the pressure drop. The compliant membranes 12, 12' flex and move with changes in pressure, which changes the volume of the plenums 44, 44' that can be occupied by the ink. The volume changes such that the pressure variations within the plenums 44, 44' are minimized and steady ink replenishment to nozzles 50, 50' continues.

To further illustrate the present disclosure, examples are given herein. It is to be understood that these examples are provided for illustrative purposes and are not to be construed as limiting the scope of the disclosure.

Example 1

Modeling of different die substrate designs was performed. Abaqus/Flow3D modeling was used to test the change in plenum pressure over time for different print head assembly (PHA) designs. Each print head assembly included a silicon die, packaging, drive electronics, and an ink delivery system. The default examples included no depression and no compliant membrane. The other examples included the silicon die substrate having the depression disclosed herein formed therein and the compliant membrane disclosed herein attached thereto.

Two depression widths were modeled, including 400 μm and 800 μm, at various depths, including 1 μm, 5 μm, 7 μm, and 11 μm.

Figure 6A:
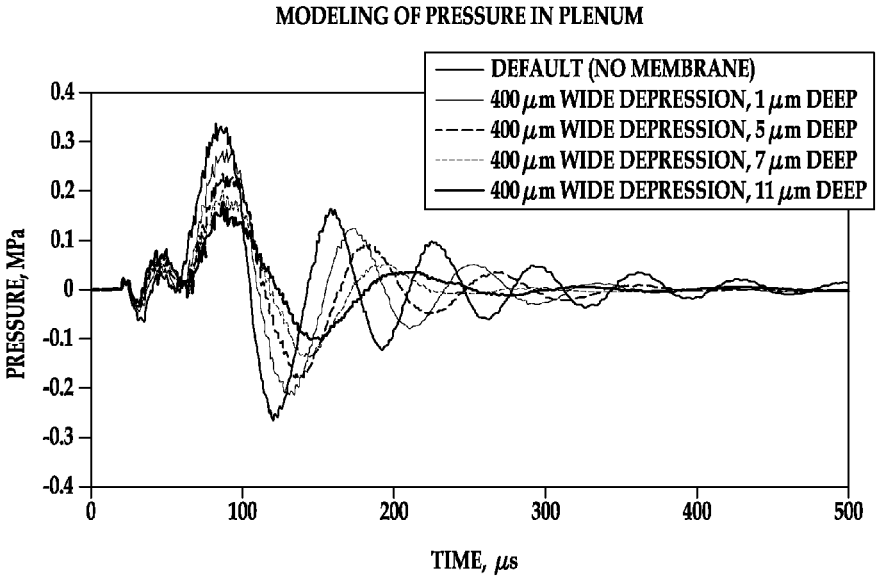
FIGS. 6A and 6B are Abaqus/Flow3D modeling graphs depicting pressure in the plenum versus time for depressions having various widths and depths.
Figure 6B:
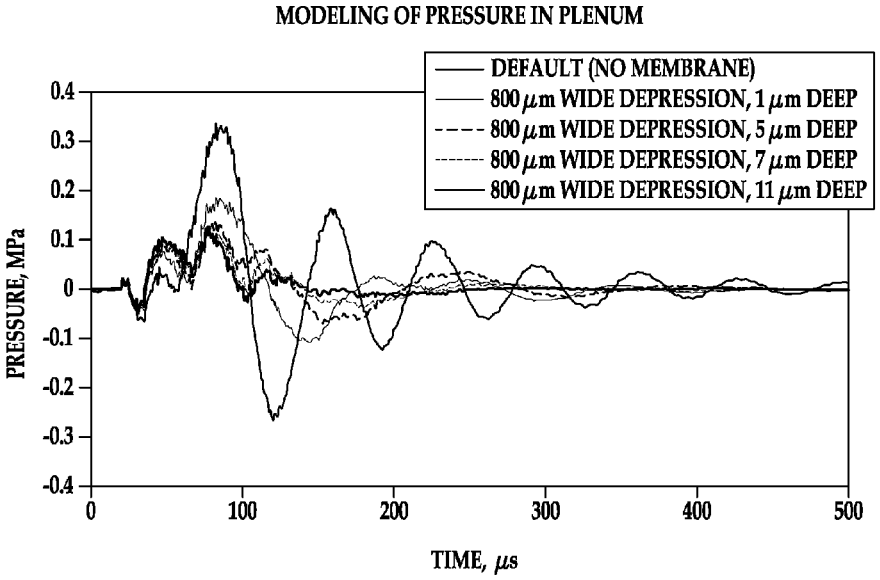

The modeled pressures in the plenum area are shown in FIGS. 6A and 6B. As depicted, the modeling showed that the width and depth of the depression contributes to reducing the pressure wave that occurs in the plenum region of the print head following a firing event. The reduced pressure wave is evidence that the compliant membrane was flexing to absorb the pressure due to ink being pushed out of the firing chamber.

The testing also showed improved crosstalk performance for the examples including the depression and compliant membrane over the default example (see, e.g., FIGS. 6A and 6B between 100 μs and 300 μs).

Example 2

Figure 7:
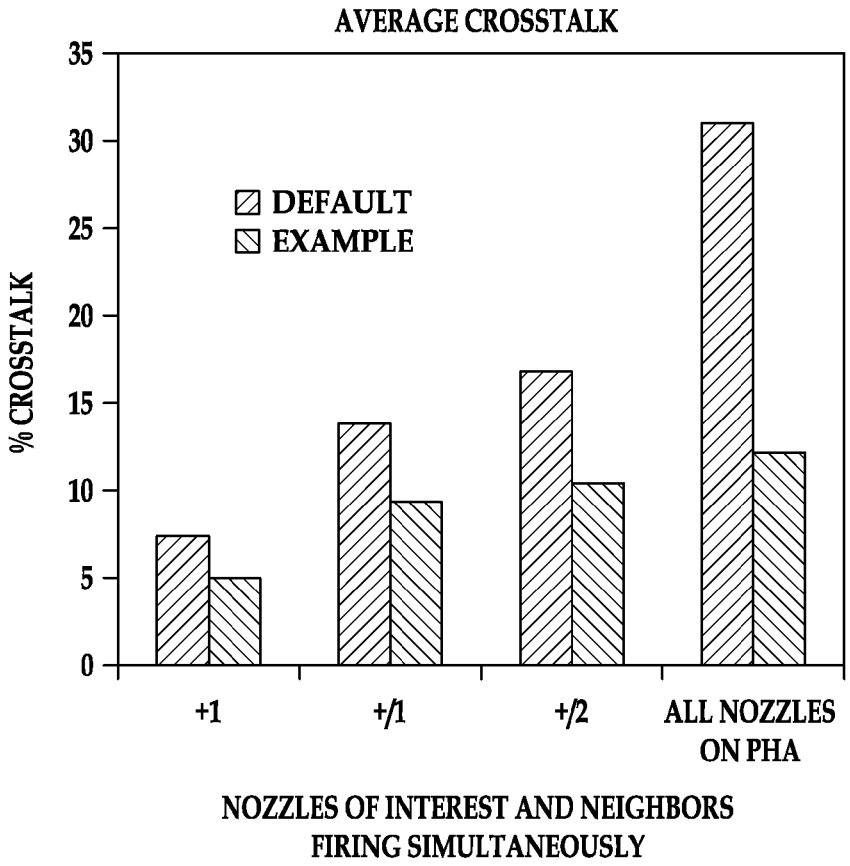
FIG. 7 is a graph depicting the average crosstalk for a printhead including an example of the die substrate disclosed herein and for a default (comparative) printhead.

A printhead was made including a die substrate with a 400 μm wide and 0.7 μm deep depression, a 25 μm thick glass compliant membrane, and 160 μm from the depression to the firing chamber inlet. The default example was the same as previously described (i.e., the die substrate included no membrane and no depression). The crosstalk for these printheads was measured. FIG. 7 illustrates the average crosstalk. The default example averaged 15-20% crosstalk, while the example including the depression and membrane averaged 8-12% crosstalk.

In order to further reduce crosstalk, it is believed that the gap 42 between the compliant membrane 12, 12' and the supports 28, 28' may be further increased; the depression width may be further increased; and/or the compliant membrane 12, 12' thickness may be further decreased.

In addition to the previously mentioned reduction in crosstalk, it is believed that the die substrates 10, 10' and compliant membranes 12, 12' disclosed herein may increase the Helmholtz frequency of the printhead 100, and thus may also increase the firing speed and throughout of the printer incorporating the printhead 100. It is also believed that the drop velocity change with frequency may be dampened, which would result in more uniform ink drop placement.

Concentrations, amounts, and other numerical data may be expressed or presented herein in a range format. It is to be understood that such a range format is used for convenience and brevity and thus should be interpreted flexibly to include not only the numerical values explicitly recited as the limits of the range, but also to include the individual numerical values or sub-ranges encompassed within that range as if each numerical value and sub-range is explicitly recited. As an illustration, a numerical range of "about 1 mm to about mm should be interpreted to include not only the explicitly recited values of about 1 mm to about 5 mm, but also include individual values and sub-ranges within the indicated range. Thus, included in this numerical range are individual values, such as 2, 3.5, 4, etc., and sub-ranges, such as from 1 to 3, from 2 to 4, and from 3 to 5, etc. This same principle applies to ranges reciting a single numerical value (e.g., up to X). Furthermore, such an interpretation should apply regardless of the breadth of the range or the characteristics being described.

While several examples have been described in detail, it will be apparent to those skilled in the art that the disclosed examples may be modified. Therefore, the foregoing description is to be considered non-limiting.

What is claimed is:

1. A printhead, comprising:

a die substrate having a surface;

a trench defined in the die substrate surface, and having a trench surface;

a support positioned in the trench;

a compliant membrane attached to the die substrate surface; and a gap defined between a distal end of the support and the compliant membrane;

wherein the trench includes:

a depression having a depth measured from the die substrate surface and defined in the trench surface by at least two opposed walls, the two opposed walls respectively terminating in first and second shoulders extending from the depression to the trench surface, the first and second shoulders respectively having a first shoulder depth and a second shoulder depth, each respectively measured from the die substrate surface, wherein the second shoulder depth is less than the first shoulder depth, and the first shoulder depth is less than the depression depth;

wherein the support is positioned between the at least two opposed walls, on a portion of the trench surface that defines the depression;

and wherein the printhead further includes:

a second support having two ends, one of the two ends being in contact with a portion of the trench surface that defines the first shoulder, and an other of the two ends being in contact with the compliant membrane.

2. The printhead as defined in claim 1 wherein the gap ranges from about 0.5 microns to about 15 microns.

3. The printhead as defined in claim 1 wherein the die substrate has a second die substrate surface opposed to the die substrate surface, and wherein the printhead further comprises:

a second trench defined in the second die substrate surface, and having a second trench surface;

a third support positioned in the second trench;

a second compliant membrane attached to the second surface; and a second gap defined between a distal end of the third support and the second compliant membrane;

wherein the second trench includes:

a second depression having a depth measured from the second die substrate surface and defined in the second trench surface by a second at least two opposed walls, the second two opposed walls respectively terminating in third and fourth shoulders extending from the second depression to the second trench surface, the third and fourth shoulders respectively having a third shoulder depth and a fourth shoulder depth, each respectively measured from the second die substrate surface, wherein the fourth shoulder depth is less than the third shoulder depth, and the third shoulder depth is less than the second depression depth;

wherein the third support is positioned between the second at least two opposed walls, on a portion of the second trench surface that defines the second depression;

and wherein the printhead further includes:

a fourth support having two ends, one of the two fourth support ends being in contact with a portion of the second trench surface that defines the third shoulder, and an other of the two fourth support ends being in contact with the second compliant membrane.

4. The printhead as defined in claim 1 wherein the trench defines a plenum and a firing chamber.

5. The printhead as defined in claim 1 wherein the second shoulder includes, at an end distal to the respective one of the two opposed walls which terminates in the second shoulder, an end wall terminating in an end shoulder extending from the second shoulder to the trench surface, and wherein the end shoulder has a depth measured from the die substrate surface, the end shoulder depth being less than the second shoulder depth.

6. The printhead as defined in claim 3 wherein each of the gap and the second gap ranges from about 0.5 microns to about 15 microns.

7. The printhead as defined in claim 3 wherein the trench defines a plenum and a firing chamber, and the second trench defines a second plenum and a second firing chamber.

8. The printhead as defined in claim 1 wherein the second support having the other of the two ends in contact with the compliant membrane is bonded thereto.

9. The printhead as defined in claim 1 wherein the compliant membrane thickness ranges from about 2 μm to about 100 μm.

10. The printhead as defined in claim 1, further comprising a plurality of the second supports in contact with the portion of the trench surface that defines the first shoulder and in contact with the compliant membrane, each of the plurality being spaced apart from one another.

* * * * *